US008758674B2

(12) United States Patent
Miani

(10) Patent No.: US 8,758,674 B2
(45) Date of Patent: Jun. 24, 2014

(54) FURNACE SLAG DOOR AND CORRESPONDING FURNACE

(75) Inventor: Stefano Miani, Premariacco (IT)

(73) Assignee: SMS Concast Italia SpA, Udine (IT)

( * ) Notice: Subject to any disclaimer, the term of this patent is extended or adjusted under 35 U.S.C. 154(b) by 305 days.

(21) Appl. No.: 13/361,174

(22) Filed: Jan. 30, 2012

(65) Prior Publication Data

US 2012/0205841 A1 Aug. 16, 2012

(30) Foreign Application Priority Data

Feb. 16, 2011 (EP) ..... 11001332

(51) Int. Cl.

| | |
|---|---|
| ***F27D 3/00*** | (2006.01) |
| ***F27B 3/19*** | (2006.01) |
| ***F27B 3/10*** | (2006.01) |
| ***F27D 1/18*** | (2006.01) |

(52) U.S. Cl.

CPC ..... *F27D 1/1858* (2013.01); *F27B 3/19* (2013.01); *F27B 3/10* (2013.01)

USPC ..... 266/271; 373/71

(58) Field of Classification Search

CPC ..... F27B 3/105; F27D 1/1858; F27D 1/1866

USPC ..... 266/135, 45, 236, 271, 272; 373/71

See application file for complete search history.

(56) References Cited

U.S. PATENT DOCUMENTS

| | | | | |
|---|---|---|---|---|
| 8,124,004 | B2 * | 2/2012 | Wunsche | 266/135 |
| 8,206,642 | B2 * | 6/2012 | Shver | 266/45 |
| 2011/0038391 | A1 * | 2/2011 | Miani et al. | 373/71 |
| 2012/0205841 | A1 * | 8/2012 | Miani | 266/200 |

FOREIGN PATENT DOCUMENTS

| | | | |
|---|---|---|---|
| WO | 2006016201 | A1 | 2/2006 |
| WO | 2010094584 | A1 | 8/2010 |

* cited by examiner

*Primary Examiner* — Scott Kastler

(74) *Attorney, Agent, or Firm* — Christopher L. Parmelee; Walker & Jocke

(57) ABSTRACT

The invention relates to a furnace slag door, comprising at least one panel which is moveable, in a mounted state of the slag door, from an opened position, in which the panel is remote from a corresponding slag discharge opening within the furnace wall to a closed position, in which the panel covers at least part of said slag discharge opening. The invention further comprises a corresponding furnace equipped with such slag door. The furnace is, in particular, an electric arc furnace (EAF) but may be as well of another type.

28 Claims, 5 Drawing Sheets

10
Y
X
Z
34
35
16
38a
30a
31
14
20
28a
38b
40
26
22
22P
22S
32b
30b
28b
42
41
42a
12
12b
42b

T
V
H
V
42b
I 42
42a
42b 42
35
41
42a
31
42b 10
12t
12
22p
12l
22
12r
16
24
24s
42b
14

FURNACE SLAG DOOR AND CORRESPONDING FURNACE

The invention relates to a furnace slag door, comprising at least one panel which is moveable, in a mounted state of the slag door, from an opened position, in which the panel is remote from a corresponding slag discharge opening within the furnace wall to a closed position, in which the panel covers at least part of said slag discharge opening. The invention further comprises a corresponding furnace equipped with such slag door. The furnace is, in particular, an electric arc furnace (EAF) but may be as well of another type.

As far the following description refers to any directions such as top, bottom, left, right, outside, inside etc. these refer to a regular melting position of a furnace equipped with a slag door (as shown in the figures).

The closed position describes a position of the respective panel, when said panel covers at least part of the corresponding slag discharge opening. In the opened position the panel is remote from this opening, so that slag and/or any other materials may be drawn off the furnace interior via said opening.

A slag door of the generic type mentioned is known i.a. from WO 2010/094584 A1. The slag door comprises two panels, an upper panel and a lower panel. While the upper panel is only forwarded from its opened to its closed position the lower panel may be further pushed through the slag discharge opening into the furnace and pulled back again. This is achieved by support means for the lower panel which follow a lever parallelogram. This additional movement of the lower panel allows slag scraping along corresponding surface areas next to the slag discharge opening. Because of the hinged movement of the lower panel its scraping path is limited with respect to its length and effectiveness.

SUMMARY OF THE DISCLOSURE

It is an object of the invention to provide a slag door and a corresponding furnace presenting improvements in closing, opening and use of said slag door for scraping any slag or other materials around a corresponding slag discharge opening.

The invention is based on the proposal to provide a slag door which allows an optimized scraping of slag and other materials which was deposited within the slag discharge opening and any areas in the vicinity of this opening. This is achieved by a telescopic slide-out structure which allows a corresponding panel (especially the lower panel of a multi part slag door) to be moved easily, along a long distance and alternating from its closed position into the furnace interior and back again, thereby contacting the corresponding bottom part of the opening and/or any furnace surfaces placed next to it.

This telescopic arrangement further allows to retract the respective panel not only up to its position closing the slag discharge opening but to a place (position) further ahead, that means to a position, where at least the lower edge of the panel being arranged outside the slag discharge opening, thereby allowing further contact of at least the lower edge of the panel to scrape any slag and/or other materials along corresponding surface sections in front of the opening.

At the same time the alternative movement by said telescopic slide-out allows reproducible and quick actions to free all areas in front, along and behind said slag discharge opening from any materials, mainly slag or scrap.

In its most general embodiment the invention provides a furnace slag door, comprising:

at least one panel, moveable, in a mounted state of the slag door, from an opened position, in which the panel is remote from a corresponding slag discharge opening, to a closed position, in which the panel covers at least part of said slag discharge opening, wherein the panel is part of a telescopic slide-out, allowing to push to the panel through said slag discharge opening into the associated furnace and pull it back again.

Depending on the size of the slag discharge opening it may be advantageous to provide a multi-part slag door.

According to one embodiment such a multi panel slag door may comprise:

an upper panel, moveable, in a mounted state of the slag door, along a path, from an opened position outside and above a corresponding slag discharge opening of the furnace to a closed position covering an upper part of the slag discharge opening, a lower panel, moveable, in a mounted state of the slag door, from an opened position outside and above the slag discharge opening to a closed a position covering a lower part of the slag discharge opening, wherein the lower panel is part of said telescopic slide-out.

The movement (path) of said upper panel may by vertically or inclined with respect to a vertical plane, or a combination of a vertical and/or inclined and/or horizontal movement. It is possible to move the upper panel only along an inclined moving path from the opened into the closed position, for example along corresponding rails.

According to one embodiment the slag door provides a lower panel which, in the mounted state of the slag door, is moveable along a path, inclined with respect to the vertical plane, from the opened position to the closed position. In this case the lower panel follows only one movement direction. Again, similar to the movement path of the upper panel, this movement of the lower panel may as well be a combination of a vertical and/or inclined and/or horizontal movement, the latter especially for movement of the lower panel toward the slag discharge opening or into the slag discharge opening. The same is true if the slag door comprises only one panel.

An inclined path for movement of the lower panel may be parallel to the path along which the upper panel (and/or any other panel) being moved between the positions mentioned. This design is especially advantageous when the respective panels are commonly moved between their respective closed and opened positions (strokes). This common move may be achieved by a mechanical link between the respective supports of the panels. The panels may be guided along rail-like guiding means (arranged with a distance to each other at lateral ends of the panels) between these positions. Connecting bars and/or supports may serve to arrange the respective panel(s).

Corresponding movement direction and guiding means may be used in an embodiment with only one panel.

The guidance (movement) between closed and opened position of at least one panel may be achieved by hydraulic actuator means, especially hydraulic piston-/cylinder combinations.

A (further) hydraulic actuator may also be used to push the panel, used for scraping purposes, from its closed position into the furnace interior and/or to pull it back again, including further pulling/pushing into a position outside the slag discharge opening. In other words: The telescopic slide-out, to which this panel is mounted, may be moved as well by hydraulic actuator means. This additional movement is typically independent from any movement of any further panel between respective closed and opened positions. This additional movement is responsible for the scraping action which is carried out by this panel.

The scraping action may be further improved by additional scraping means at the circumference of the panel, especially along its lower edge, next to the surface to be cleaned. This scraping means may be discrete teeth, pins or the like as well as traverse bars with a corresponding profiled scraping edge.

The telescopic slide-out arrangement may be realized in different embodiments allowing the corresponding panel to be moved, when it reached its position right in front or within the slag discharge opening (the closed position), in a general horizontal movement into the furnace interior and back again. The term "horizontal movement" includes all patterns by which the panel is directed from a position in front of the slag discharge opening or a position within the slag discharge opening into a position behind the slag discharge opening and vice versa. Insofar it may be designed in such a way that a corresponding longitudinal movement of the panel may be effected along at least one of the following patterns: wavelike, saw tooth like, involute like, zigzag, linear, dredger like. These non-linear movements are all summerized under the term "horizontal movement".

Such "linear and/or non-linear" movement has the advantage that the lower panel may be used effectively to scrape all slag and/or other solid and viscous materials deposited along the corresponding motion (way of movement) of the panel. It may further follow any irregularities of the surface of such deposits and provide a "cleaned" surface after it has been moved at least once in the way described. It becomes clear from the task of this scraping panel (besides its function to close the slag discharge opening in its closed position) that an alternating movement improves this function, i.e. that the lower panel may be moved in an alternating fashion several times between a forwarded and a retracted position. During its way into the furnace and back again its may be agitated by only one pattern, for example the wave-like pattern or by several patterns of the type mentioned.

Insofar the movement of the lower panel may be characterized by at least two subsequent patterns.

The telescopic suspension of the scraping panel may be realized, according to one embodiment of the invention, in a part of a panel support which part extends mostly horizontally (when the slag door is in its mounted state). This part can comprise a guide rail, hollow bar or the like, cooperating with a corresponding piston, bar or the like, to which the panel is mounted (at its end) and along which a corresponding actuator, for example a piston-/cylinder means and corresponding bearings is arranged to move the associated panel in the desired way. In order to achieve the respective pattern the support to which the panel is mounted, may be guided along corresponding guiding means, for example corresponding slits (for example wavelike slits) in the side walls of said bar/rail. The panel can (further) be attached to the piston of a piston/cylinder unit by a cardan joint or similar connecting means allowing the desired non-linear movement.

The term telescopic slide-out further includes other constructions/layouts and/or other actuator means by which a corresponding "horizontal" and alternating movement of the scraping panel may be achieved. The telescopic slide-outs are generally independent from any other movement means for said panels, especially those for transferring the panels from their opened position into their closed position.

While the scraping panel is moved from its opened position (so called "opening stroke") to its closed position (so called "home position") in a linear way its scraping movement typically follows any of the patterns mentioned.

The telescopic slide out allows to move the corresponding panel in a predetermined fashion during its scraping action and thus to adapt the panel movement to any individual construction, design and local situation. It further allows to predetermine any desired shape of a final surface of those areas, along which the scraping panel has been moved.

In a two panel embodiment the upper panel may be moved by the same means from its opened into its closed position as used for the lower panel. Both may be moved commonly or independently from each other.

The invention further provides a furnace, especially an EAF, comprising

- a refractory lined lower shell,
- a cooled upper shell,
- a metal charge opening,
- a slag discharge opening within the cooled upper shell, and
- a slag door, mounted externally (at the outer periphery of the furnace shell) adjacent to the slag discharge opening, wherein the slag door is a slag door as described above.

At least one panel may be dimensioned such that a gap remains between an outer periphery of the respective panel and a corresponding outer frame portion of the discharge opening when the respective panel is in its "closed position", also called "home position". That means that the panel(s) not necessarily close the slag discharge opening hermetically, although it (they) may do so. Any clearance between the respective slag door panel and the corresponding frame of the slag discharge opening (the tunnel-like opening in the furnace wall) does not influence the function of the EAF negatively as the metal melt is always arranged in the lower shell of the furnace, i.e. below the bottom of the slag discharge opening. In contrary: Any clearance secures an unrestricted (unhindered) movability of the slag door.

The upper panel of the multi-part slag door may be arranged, in its closed position, such that its lower edge lies within the tunnel space defined by the slag discharge opening, while its upper edge lies outside of said tunnel space, i.e. the upper panel is inclined, for example by up to 15 degrees with respect to an imaginary vertical plane, but a vertical arrangement is as well possible (meaning 0 degrees with respect to said imaginary vertical plane).

Further features of the invention may be apparent from the sub-claims and the other applications documents, including the figures and corresponding explanations.

In the attached drawings the following is shown schematically:

BRIEF DESCRIPTION OF THE DRAWINGS

FIG. 1*b*: a side view according to FIG. 1*a*

DETAILED DESCRIPTION

Figure 1A:
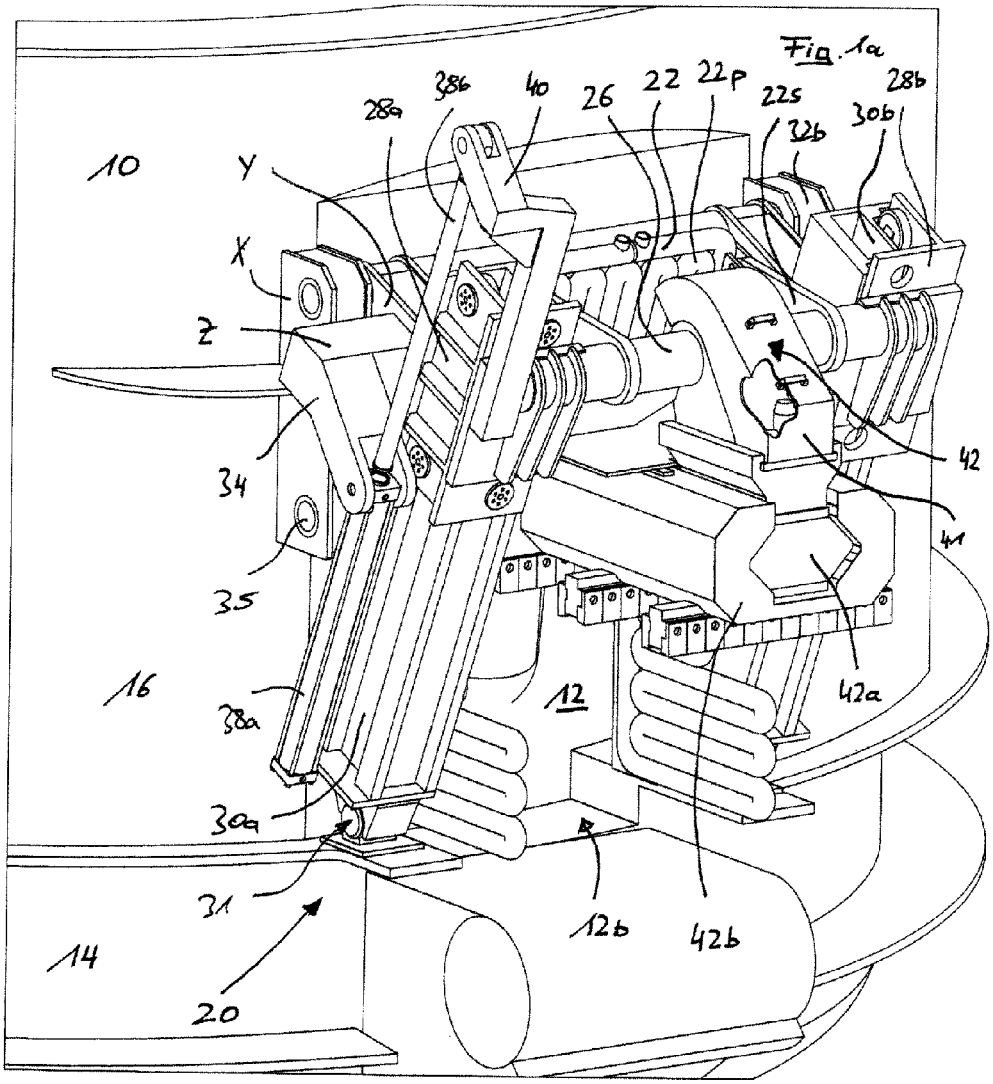
FIG. 1*a*: a 3-dimensional view of a slag discharge area of an electric arc furnace and its associated slag door in its opened position
Figure 16:
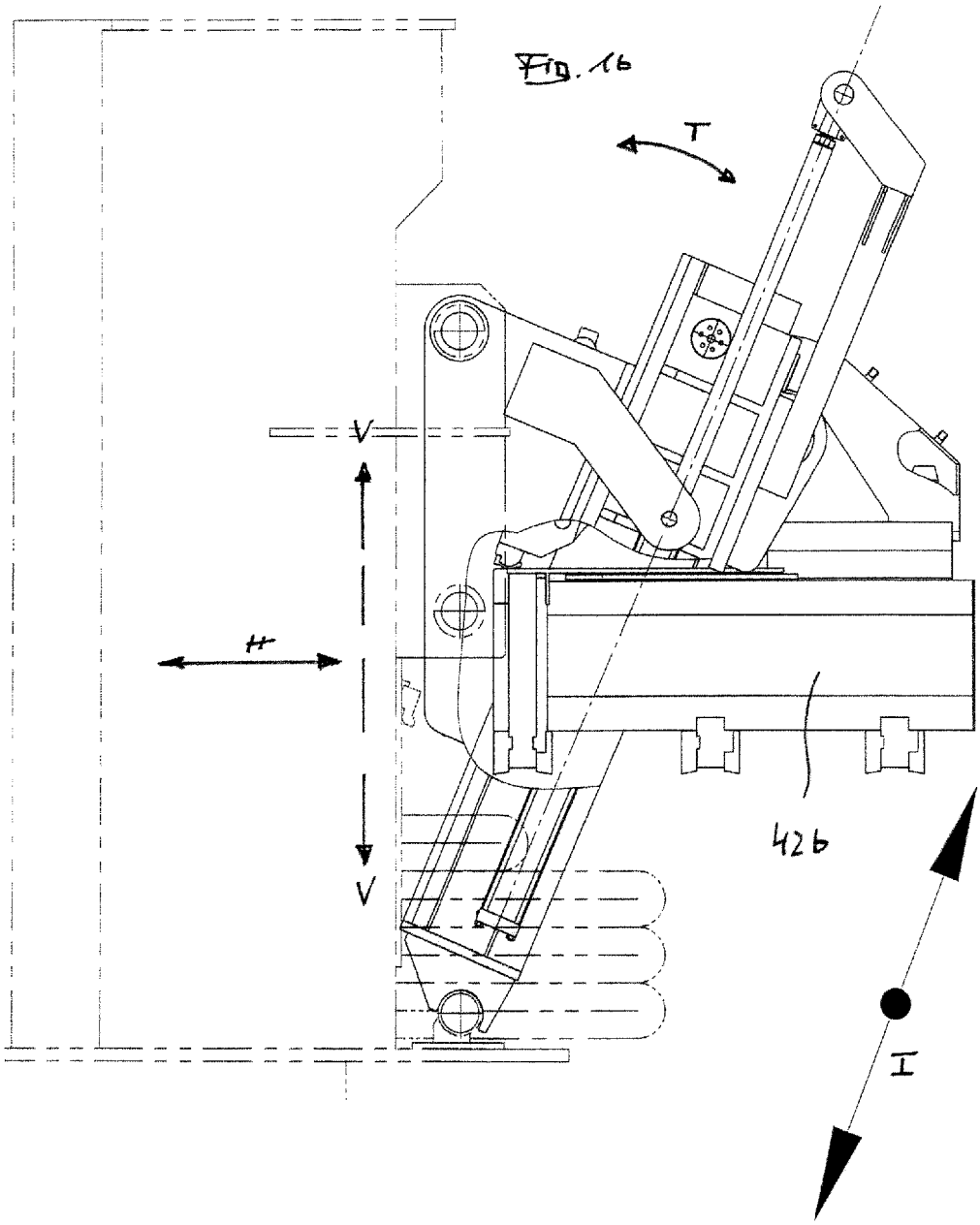

All Figures show a partly view onto that part of an electric arc furnace 10, comprising a so called slag discharge opening 12, which may be closed (partly or completely) by a corresponding slag door 20.

They further show part of a lower shell 14 and an upper shell 16 of said electric arc furnace. While the lower shell 14 is lined with a refractory material (either bricks or a monolithic lining) the upper shell 16 is characterized by cooling panels. As said refractory lining of that part of the furnace, comprising a metal melt, and the upwardly extending cooling panels (which serve as a barrier against slag and onto which a solidified slag layer is built up during processing of the furnace) belong to common prior art these features are not further shown and described.

The same is true with respect to any corresponding opening in the furnace to charge metal and the design of the slag discharge opening 12, forming a tunnel-like opening within the upper shell 16. Said discharge opening 12 is limited by a bottom portion 12*b*, provided by the upper end of the lower shell 14 and/or a corresponding metal/slag layer formed thereon, two frame portions 12*l,r* extending perpendicularly from said bottom portion 12*b* and a top portion 12*t* opposite to bottom portion 12*b*.

Figure 2:
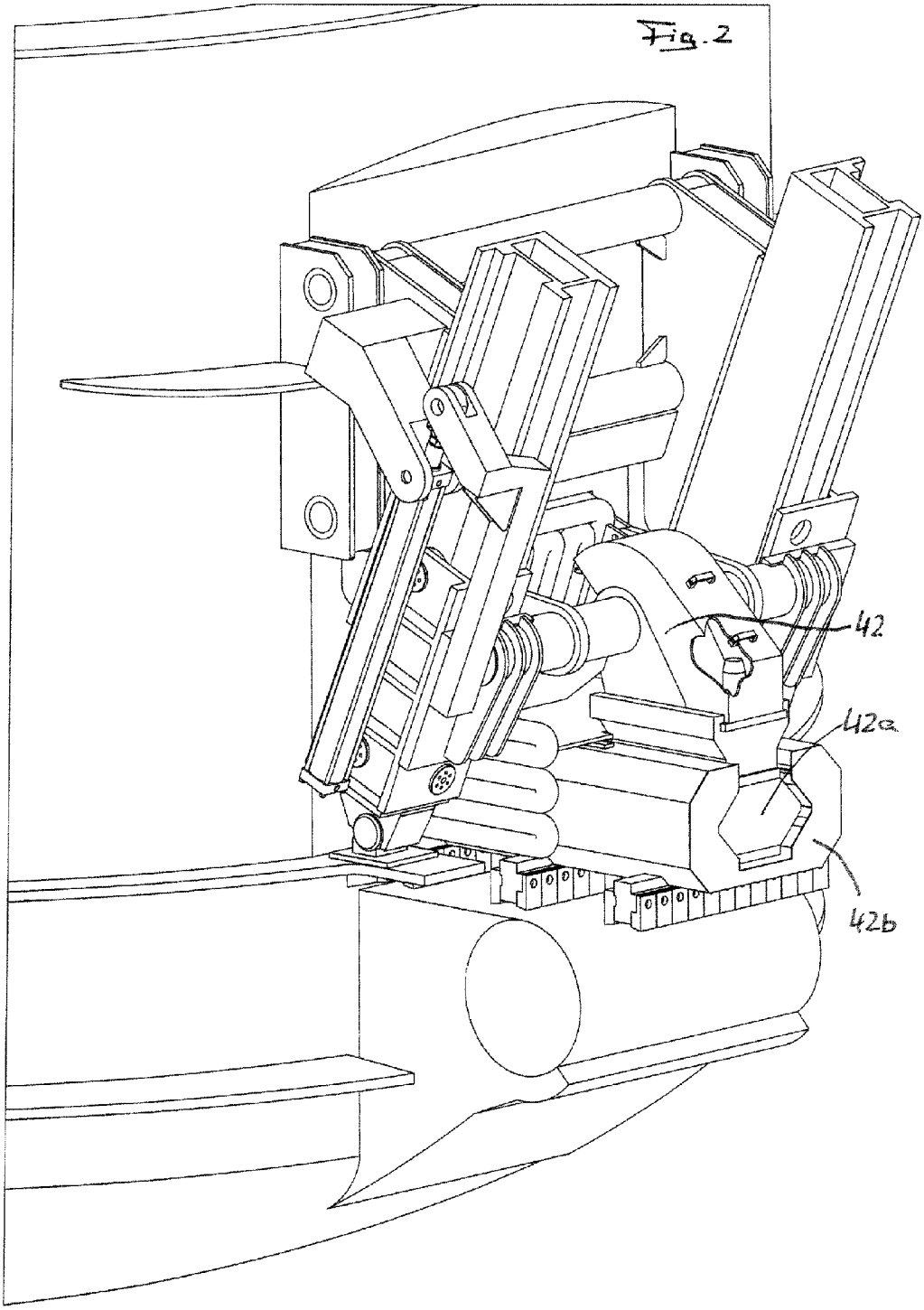
FIG. 2: same as FIG. 1 with the slag door in its home position
Figure 3:
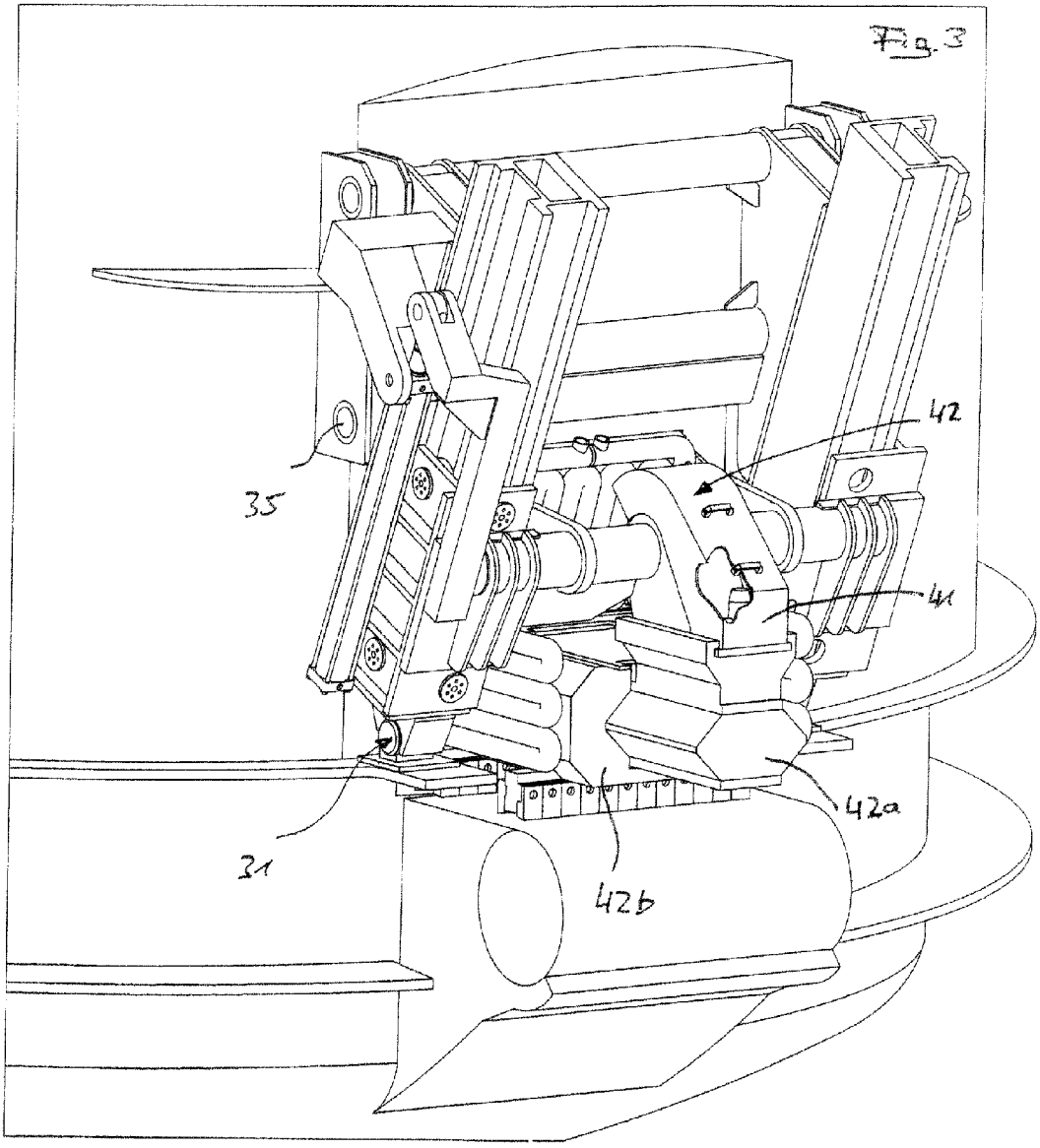
FIG. 3: same as FIG. 2 with a lower panel of the slag door in its scraping position

During melting, i.e. especially when scrap is melted in the electric arc furnace 10, slag door 20 predominantly is arranged in a position called "home position" shown in FIG. 2.

Slag door 20 comprises an upper panel 22 (made of water cooled pipe sections 22*p*) and a lower panel 24. Upper panel 22 is mounted by levers 22*s* to a rod 26, extending between supports 28*a*,28*b* guided along rail-like guiding bars 30*a*, 30*b*, which bars 30*a*,30*b* are inclined (arrow I in FIG. 1*b*) with respect to a vertical plane (arrow V in FIG. 1*b*) when the said slag door 20 is mounted on the outer wall of upper shell 16 of furnace 10. These rail-like guiding bars 30*a*,30*b* are secured at their respective bottom end in a pivot bearing 31.

A further bracket 34 serves to pivotally fasten a cylinder 38 of a hydraulic piston-/cylinder unit, the piston of which is marked by numeral 38*b* and pivotally secured at its upper free end to an arm 40, which carries, at its opposite end, support 28*a* (fixed to support 28*a*).

Figure 4:
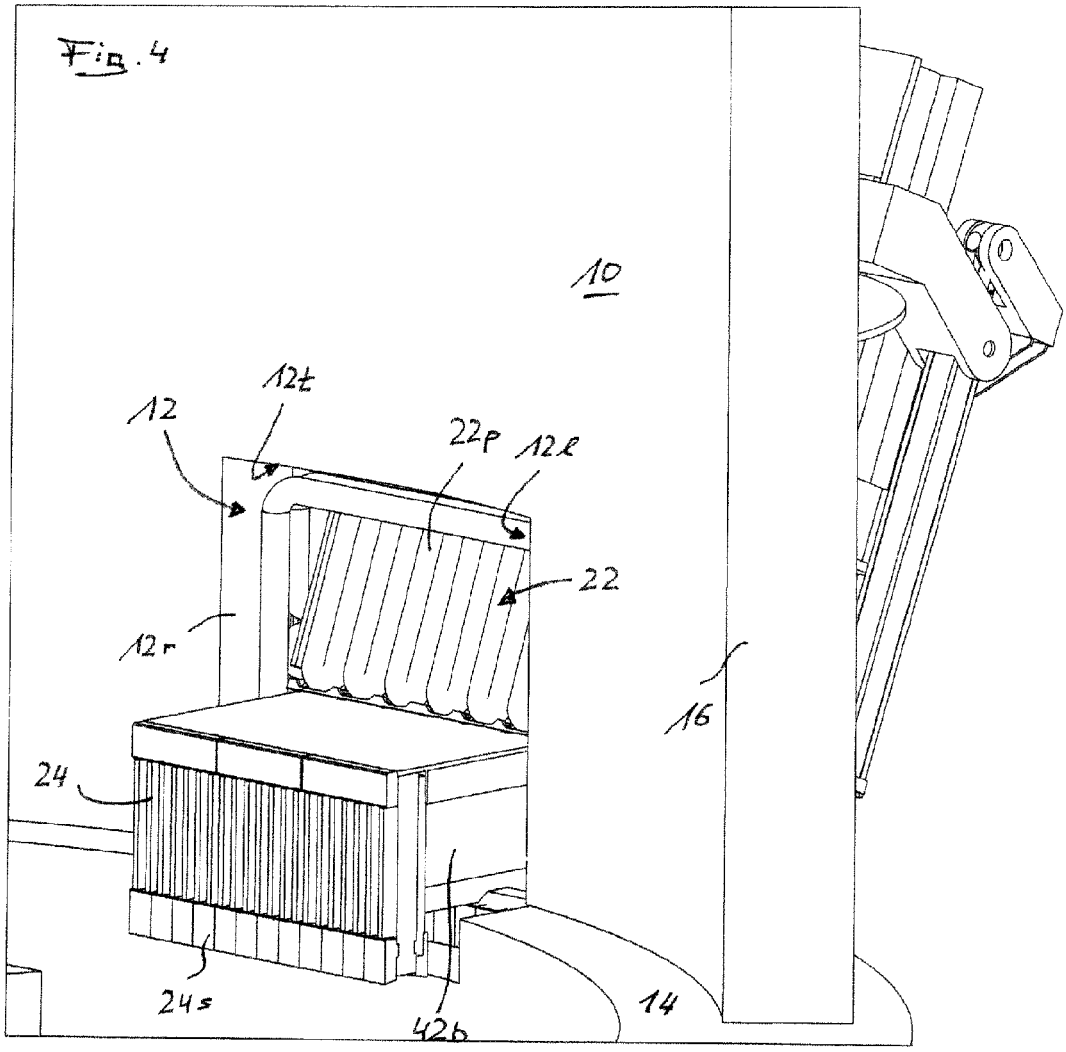
FIG. 4: a 3-dimensional view onto the inner side of the slag discharge area when the slag door is in its position according to FIG. 3

A first part 41 of a support 42 for lower panel 24 is pivotally fastened onto said rod 26 (between levers 22*s*) and extends downwardly with a part 42*a* into a second part 42*b* of said support 42, which second part 42*b* extends mostly horizontally. This lower end 42*a* of part 41 is slidably guided within said second part 42*b*, which provides a U like cross section with an upper opening of smaller width than in an associated inner section. The lower end 42*a* of upper part 41 is shaped correspondingly to allow the desired alternating sliding movement. The lower panel 24 is mounted at the inner free end of part 42*b* (FIG. 4) and may be moved from its closed position (FIG. 2) through the slag discharge opening 12 into the furnace interior by (non illustrated) hydraulic actuator means, pushing part 42*b*/lower panel 24 into the furnace interior and pulling them back again. During the return way the lower panel 24 may be retracted into a position behind the closed position, i.e. into a position in front of the slag discharge opening 12.

This movement of lower panel 24 serves to scrape any slag, metal/slag mixtures and/or other substances from the corresponding inner wall portions of said electric arc furnace 10 and/or the tunnel area, formed by the slag discharge opening 12 and/or any surfaces in front of the slag discharge opening 12.

As these formations of mostly solid material have in most cases an irregular shape the invention provides for a lower panel 24 able to move not only in a substantially linear direction into the furnace 10 and back again but along totally different patterns.

For this purpose the guiding means for scraping movement of the lower panel 24 are adapted accordingly as described in the general part above.

According to one embodiment the said hydraulic actuator for the lower panel may be hingedly secured by a cardan joint, which allows lower panel 24 to follow any wavelike or other non-linear movement on its way into furnace 10 and back again.

In other words: lower panel 24 is part of a telescopic slide-out, allowing to push to lower panel 24 through the slag discharge opening 12 into the associated electric arc furnace 10 an pull it back again up to a position outside slag discharge opening 12. On its way lower panel 24 may contact the corresponding bottom part 12*b* of slag discharge opening 12 and/or any associated surface areas on both sides of this opening 12.

For scrapping purposes the invention provides additional scraping means especially at the lower edge of lower panel 24, i.a. shaped as teeth, shaped as a comb, a rake, a brush or the like, symbolized by reference numeral 24*s*.

The motion of the scraping panel (in the embodiment according to the Figures: the lower panel 24) may be supported by a further movement of the guiding means to which the upper panel 22 and/or the first part 42*a* of the lower panel are mounted, for example a tilting movement (arrow T in FIG. 1*b*). This tilting movement may be realized by corresponding pivot joints for fastening the panels 22,24 and/or parallelogram-like lever arrangements and indicated in the figures by reference numeral 35.

As may be seen from FIGS. 1*a,b* and 2 upper panel 22 and lower panel 24 are forwarded in a common movement from their opened position (FIG. 1*a,b*) into their closed position (FIG. 2), This movement is linear (arrow I FIG. 1*b*) according to the corresponding linear guide-rails (guiding bars) 30*a*, 30*b* along which the corresponding panel supports 28*a*,28*b* are moved.

The invention claimed is:

1. A furnace slag door, comprising:

1.1 at least one panel, moveable, in a mounted state of the slag door, from an opened position, in which the at least one panel is remote from a corresponding slag discharge opening, to a closed position, in which the at least one panel covers at least part of said slag discharge opening, wherein 1.2 the at least one panel is part of a telescopic slide-out that is configured to push the at least one panel through said slag discharge opening into an associated furnace and pull the at least one panel back again, wherein 1.3 the telescopic slide-out pushes and pulls the at least one panel in a motion that is collinear with the telescopic motion of the telescopic slide-out.

2. The slag door according to claim 1, comprising:

2.1 an upper panel, 2.2 moveable, in the mounted state of the slag door, from an opened position outside and above a corresponding slag discharge opening to a closed position covering an upper part of the slag discharge opening, 2.3 a lower panel, 2.4 moveable, in the mounted state of the slag door, from an opened position outside and above the slag discharge opening to a closed position covering a lower part of the slag discharge opening, wherein 2.5 the lower panel is part of said telescopic slide-out.

3. The slag door according to claim 2, wherein at least one of the lower panel and the upper panel, in the mounted state of the slag door, is moveable along a path, which path is inclined with respect to a vertical plane, from the opened position to the closed position.

4. The slag door according to claim 3, wherein the lower panel is moveable along a path being parallel to a path along which the upper panel is moved.

5. The slag door according to claim 1, wherein at least one panel is moved by a hydraulic actuator between the opened position and the closed position.

6. The slag door according to claim 1, wherein the telescopic slide-out is moved by a hydraulic actuator.

7. The slag door according to claim 1, wherein the telescopic slide-out is moveable independently of any movement of the at least one panel from an opened position to a closed position.

8. The slag door according to claim 2, wherein the upper panel and the lower panel (24) are commonly moved from respective opened to respective closed positions.

9. The slag door according to claim 2, wherein the lower panel is moveable independently of any further panel from a closed position to any position other than an opened position.

10. The slag door according to claim 1, wherein the telescopic slide-out is part of a panel support, which part extends essentially horizontally when the slag door is in the mounted state.

11. The slag door according to claim 1, wherein the telescopic slide-out is designed in such a way that a corresponding longitudinal movement of the associated at least one panel is effected along at least one of the following patterns: wave, saw tooth, involute, zigzag, linear, dredger.

12. The slag door according to claim 11, wherein the movement of the at least one panel is characterized by at least two subsequent patterns.

13. A furnace slag door, comprising:

1.1 at least one panel that is moveable in a mounted state of the slag door, from an opened position, in which the at least one panel is remote from a corresponding slag discharge opening, to a closed position, in which the at least one panel covers at least part of said slag discharge opening, wherein 1.2 the at least one panel is part of a telescopic slide-out that is configured to push the at least one panel through said slag discharge opening into an associated furnace and pull the at least one panel back again, wherein 1.3 the at least one panel is guided a guide rail between the closed and opened positions.

14. A furnace, comprising 14.1 a refractory lined lower shell, 14.2 a cooled upper shell, 14.3 a metal charge opening, 14.4 a slag discharge opening within the cooled upper shell, and 14.5 the slag door according to claim 1, at least a portion of which is mounted externally adjacent to the slag discharge opening.

15. The furnace according to claim 14, wherein the at least one panel of the slag door is configured such that in the closed position, a lower edge of the slag door lies within a tunnel space defined by the slag discharge opening while an upper edge of the slag door lies outside the tunnel space.

16. The slag door according to claim 13, comprising:

2.1 an upper panel, 2.2 moveable, in the mounted state of the slag door, from an opened position outside and above a corresponding slag discharge opening to a closed position covering an upper part of the slag discharge opening, 2.3 a lower panel, 2.4 moveable, in the mounted state of the slag door, from an opened position outside and above the slag discharge opening to a closed position covering a lower part of the slag discharge opening, wherein 2.5 the lower panel is part of said telescopic slide-out.

17. The slag door according to claim 16, wherein at least one of the lower panel and the upper panel, in the mounted state of the slag door, is moveable along a path, which path is inclined with respect to a vertical plane, from the opened position to the closed position.

18. The slag door according to claim 17, wherein the lower panel is moveable along a path being parallel to a path along which the upper panel is moved.

19. The slag door according to claim 13, wherein at least one panel is moved by a hydraulic actuator between the opened position and the closed position.

20. The slag door according to claim 13, wherein the telescopic slide-out is moved by a hydraulic actuator.

21. The slag door according to claim 13, wherein the telescopic slide-out is moveable independently of any movement of the at least one panel from an opened position to a closed position.

22. The slag door according to claim 16, wherein the upper panel and the lower panel (24) are commonly moved from respective opened to respective closed positions.

23. The slag door according to claim 16, wherein the lower panel is moveable independently of any further panel from a closed position to any position other than an opened position.

24. The slag door according to claim 13, wherein the telescopic slide-out is part of a panel support, which part extends essentially horizontally when the slag door is in the mounted state.

25. The slag door according to claim 13, wherein the telescopic slide-out is designed in such a way that a corresponding longitudinal movement of the associated at least one panel is effected along at least one of the following patterns: wave, saw tooth, involute, zigzag, linear, or dredger.

26. The slag door according to claim 25, wherein the movement of the at least one panel is characterized by at least two subsequent patterns.

27. A furnace, comprising 14.1 a refractory lined lower shell, 14.2 a cooled upper shell, 14.3 a metal charge opening, 14.4 a slag discharge opening within the cooled upper shell, and 14.5 the slag door according to claim 13, at least a portion of which is mounted externally adjacent to the slag discharge opening.

28. The furnace according to claim 27, wherein the at least one panel of the slag door is configured such that in the closed position, a lower edge of the slag door lies within a tunnel space defined by the slag discharge opening while an upper edge of the slag door lies outside the tunnel space.

* * * * *